United States Patent [19]

Yoshida et al.

[11] Patent Number: 4,814,145

[45] Date of Patent: Mar. 21, 1989

[54] APPARATUS FOR CARBONIZING AND ACTIVATING FIBER MATERIALS

[75] Inventors: Akihiko Yoshida; Atsushi Nishino; Ichiro Tanahashi; Yasuhiro Takeuchi, all of Osaka, Japan

[73] Assignee: Matsushita Electric Industrial Co., Ltd., Osaka, Japan

[21] Appl. No.: 868,655

[22] Filed: May 29, 1986

[51] Int. Cl.[4] ..... P01D 9/14; B01J 15/00

[52] U.S. Cl. ..... 422/150; 422/202; 423/447.7; 423/447.9

[58] Field of Search ..... 423/449.2–449.9; 422/150, 151, 156, 157, 158, 202; 432/8

[56] References Cited

U.S. PATENT DOCUMENTS

| | | | |
|---|---|---|---|
| 3,618,914 | 11/1971 | Best | 34/152 |
| 3,745,104 | 7/1973 | Hou | 423/447.7 |
| 3,772,429 | 11/1973 | Basche | 423/447.7 |
| 4,217,090 | 8/1980 | Whike et al. | 432/8 |
| 4,285,831 | 8/1981 | Yoshida et al. . | |
| 4,389,387 | 6/1983 | Miyamori et al. | 423/447.7 |
| 4,543,241 | 9/1985 | Yoshinari et al. | 423/447.7 |
| 4,610,860 | 9/1986 | Mullen | 264/29.2 |

*Primary Examiner*—Michael S. Marcus

*Attorney, Agent, or Firm*—Lowe, Price, LeBlanc, Becker & Shur

[57] ABSTRACT

A vertical apparatus for continuously carbonizing and activating various types of fiber materials. The apparatus comprising a chamber having openings at upper and lower portions thereof, at least one port through which an activating gas is passed for activation of the fiber material and a heater for keeping the temperature in the chamber, a means for vertically passing the fiber material in a continuous manner for the carbonization and activation, and a means for supplying the activating gas into the chamber. A method for continuously carbonizing and activating fiber materials in an efficient manner is also described.

15 Claims, 4 Drawing Sheets

APPARATUS FOR CARBONIZING AND ACTIVATING FIBER MATERIALS

BACKGROUND OF THE INVENTION

1. Field of the Invention

This invention relates to the manufacture of carbon fibers and activated carbon fibers and more particularly, to an apparatus and method for carbonizing and activating fiber materials.

2. Description of the Prior Art

As is well known in the art, for the manufacture of activated carbon powder or fibers by carbonizing and activating starting organic powders such as coconut shell flour, sawdust and the like, or fibrous materials, it is usual to place the starting powders or materials in an atmosphere of an inert gas at elevated temperatures of 800° to 1200° C. For the activation, a given concentration of an activating gas, such as steam or other oxidative gases, is generally introduced into the inert gas.

In practice, high temperature furnace apparatus have been used for carbonization and activation of such starting materials. The apparatus has an electric furnace using a resistance heater made, for example, of nichrome, MoSi, SiC or the like, in which a ceramic reactor tube is placed. A material to be carbonized and activated is charged into the reactor tube. The furnace is so controlled as to maintain a desired furnace temperature. An inert gas from a carrier gas bomb is passed, for example, through a steam generator into the ceramic reactor tube. An exhaust gas is discharged to outside after treatment with a suitable exhaust gas treating apparatus. In some furnaces, the ceramic reactor tube is rotated to facilitate uniform carbonization and activation.

In the carbonization and activation furnaces, a material to be treated fundamentally undergoes two reactions including a carbonization reaction in an inert gas at high temperatures and a subsequent activation reaction in which the material is reacted with an activating gas at high temperatures. However, existing furnaces are disadvantageous when used in continuous carbonization and activation of continuous materials such as, for example, woven and non-woven fabrics, felts and paper sheets. This is because the control of the atmosphere in the reactor is difficult, so that the resultant carbon fibers and/or activated carbon fibers do not have uniform properties with regard to the strength and specific surface area. In general, the carbonization reaction has to be carried out uniformly under conditions of an atmosphere containing a low oxygen content and a high temperature. On the other hand, the activation reaction using, for example, steam, is a solid-gas reaction between $H_2O$ molecules and carbon atoms at high temperatures as shown in the following formula (I). Fine pores are formed after removal of carbon atoms by the reaction, thus causing activated carbon to have a high specific surface area.

$$C_n + H_2O \rightarrow C_{n-1} + CO + H_2 \quad \text{(I)}$$

Such a solid-gas phase reaction is predominantly controlled by three factors including (1) uniformity in temperature of the reaction system, (2) a high and uniform degree of contact between the solid and the gas, and (3) rapid transfer, to outside, of the materials produced by the activation reaction e.g. CO and $H_2$ gases in the reaction formula (I). If these factors are appropriately controlled, the activation reaction proceeds smoothly, resulting in activated carbon of a high specific surface area. In other words, proper control of the above factors makes it possible to obtain activated carbon of desired characteristics.

In the known batchwise carbonization and activation furnaces using ceramic reactor tubes, the amount and position of a material to be carbonized and activated are held constant, so that the activating conditions indicated above can be relatively easily controlled. Proper control of a concentration and a flow rate of an activating gas and the manner of charging the gas into the reactor tube results in activated carbon with desired characteristic properties. However, the known furnaces are carried out by a batchwise manner, which places an inevitable limitation on the amount of a material to be activated. If the amount is too large, it becomes difficult to obtain uniformly carbonized and activated carbon products. Moreover, when a continuous fiber or cloth article is placed in the furnace in a manner as folded, the outer surfaces of the folded article are more rapidly activated than the inside of the article in the batch-type furnace. Thus, uniform activation is more difficult than in the case of powders.

To avoid the difficulty, cloth articles are generally suspended from a holder as stretched in the furnace in order to ensure uniform contact of an activating gas with the cloth. However, the cloth article where contacted with the holder undergoes activation in a degree different from the other portion of the article which does not contact the holder, with a lower strength. In Japanese Patent Publication No. 57-10205, for example, there is described a procedure of carbonizing and activating fibers in a batch-type furnace in which the fiber in the furnace is heated in air at a rate of 50° to 200° C./hour from room temperature to 450° C. and is subsequently heated in a non-oxidative atmosphere from 700° to 900° C. at the same rate as indicated above. As will be seen from the above, the carbonization and activation reactions in the batch-type furnace essentially require an accurate control of the heating rate and take a long time before the furnace and the resulting activated carbon product are cooled down to room temperature.

SUMMARY OF THE INVENTION

It is an object of the invention to provide an apparatus and method for continuously manufacturing carbon fibers and/or activated fibers of uniform properties within a relative short time.

It is another object of the invention to provide an apparatus and method for continuously manufacturing carbon and/or activated carbon fibers in the form of cloths, sheets, felts, tows or rovings.

It is a further object of the invention to provide a carbonization and activation furnace which is capable of continuously carbonizing and activating fibrous materials and is also capable of continuously thermally treating the resulting carbon in a subsequent step.

Broadly, the present invention provides a vertical furnace system for continuously carbonizing and activating continuous fiber materials which comprises:

a furnace chamber which has openings at upper and lower portions thereof, through which a continuous fiber material is passed in a vertical direction, at least one port for an activating gas and a heating means for keeping the furnace chamber at temperatures sufficient to carbonize the fiber material;

a means for continuously feeding the fiber material from one of the openings and taking up from the other opening; and an activating gas supply means for supplying an activating gas into the furnace chamber through the at least one port for activating the fiber material, whereby the fiber material is uniformly carbonized and activated in the furnace chamber. In a more specific and, in fact, preferable embodiment, the furnace is arranged such that the activating gas is fed into the furnace chamber from at least two ports provided at lower portions and/or intermediate or side wall portions of the furnace chamber, and the at least two ports are kept away from each other so as to put a running fiber material therebetween. In any case, the activating gas is naturally discharged from the upper opening by the draft effect.

According to the method of the invention, a starting continuous material to be carbonized and activated is continuously contacted with an activating gas while running in a vertical direction at temperature of 800 to 1200 for a time sufficient to permit the carbonization and activation of the material, and is subsequently thermally treated in an inert gas atmosphere at a temperature of up to 1200° C. The thermal treatment is carried out continuously with the carbonization and activation operations in the same reaction zone. However, the zone is divided into sections, which are different from each other in atmosphere. In one such section, the activating gas is blown against the running material and discharged from the inlet of the material. The other section is filled with a pressurized inert gas so that the activating gas is not contained in this section, in which the thermal treatment is effected.

DETAILED DESCRIPTION AND EMBODIMENTS OF THE INVENTION

Figure 1:
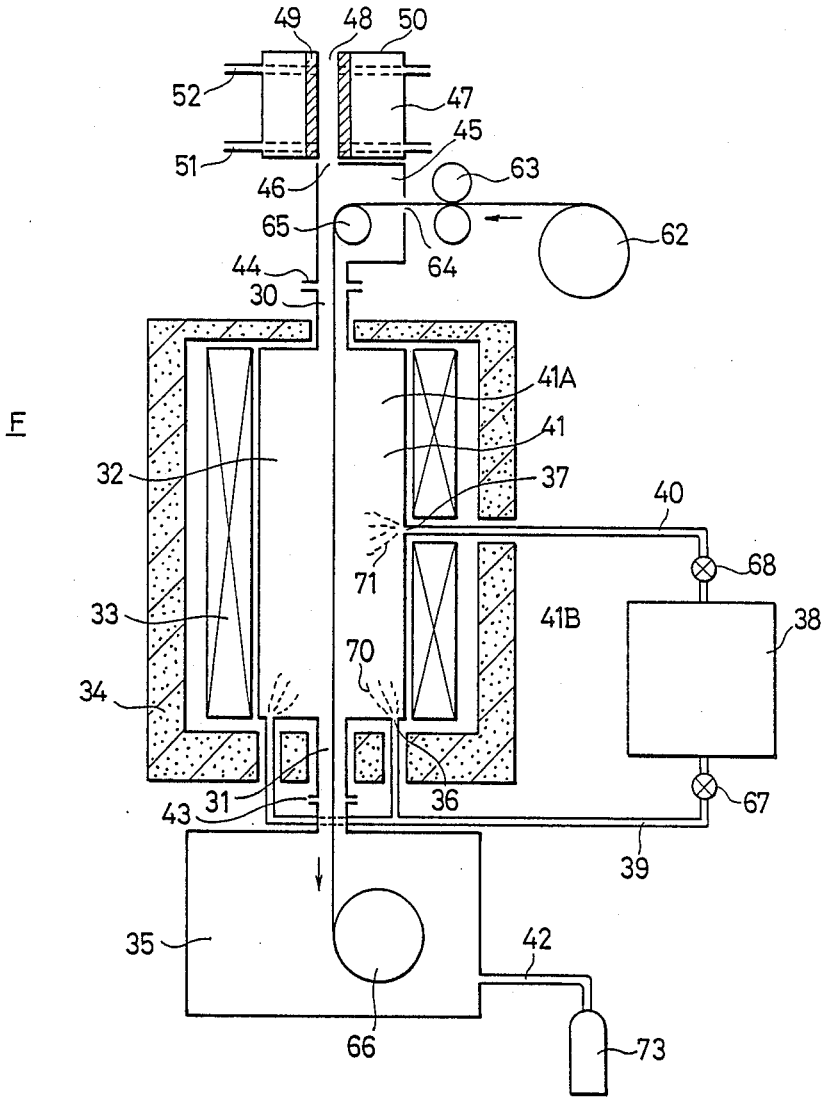
FIG. 1 is a schematic, fundamental view of a vertical furnace of carbonizing and activating fibers according to the present invention.

As described above, the vertical carbonization and activation furnace of the present invention includes a furnace chamber which has openings at upper and lower portions thereof, through which a material to be carbonized and activated is continuously passed in a vertical direction. The furnace chamber has also at least one port provided at a bottom or a side wall of the chamber, through which an activating gas is supplied.

In a preferred embodiment, the opening at the lower portion or bottom of the chamber is connected to a closed chamber in which a starting material to be carbonized and activated, or a carbonized and activated product is accomodated. On the other hand, the other opening at the upper portion is preferably connected to an exhaust gas treating device. At or in the vicinity of one or both of the openings there may be provided a means for jetting an inert gas against a running continuous starting material to be treated for closing the furnace system. Moreover, the activating gas is preferably blown against the material to be carbonized and activated from at least two ports which are kept away from each other so as to put the material therebetween, so that the material is more uniformly carbonized and activated by uniform contact with the activating gas from the two ports. As a matter course, the two ports at the bottom or the side wall of the chamber may preferably be used. Alternatively, four ports from the bottom and the side wall may preferably be used.

When the activating gas is supplied from the port or ports of the bottom or lower portion of the furnace chamber, the furnace chamber is all in an atmosphere of an activating gas for carbonization and activation. If, on the contrary, the activating gas is supplied from the ports at the intermediate portions or side wall portions of the chamber and is blown toward the inlet of the starting material, a section in the chamber lower than the supplied portion remains in an atmosphere of an inert gas. In the former case, the starting continuous material is only carbonized and activated, whereas the latter case involves a continuous thermal treatment after the carbonization and activation. The differences in effect between the two cases will be described in detail hereinafter.

According to the invention, a starting continuous material to be carbonized and activated is moved vertically in the furnace chamber in which the material contacts an activating gas in a uniform and constant fashion, so that uniform carbonization and activation proceed. When the furnace chamber is connected to a closed chamber, the concentrations of oxygen and the activating gas in the furnace chamber can be maintained almost constant. In addition, the furnace chamber may be so controlled as to give a distribution of temperature along the running direction of the starting continuous material, by which more uniform carbonization and activation may be possible.

The activating gas may be steam or any oxidative gases such as $CO_2$ or $O_2$. When steam is supplied under well-controlled conditions, more stable carbonization and activation operations become possible. For this purpose, it is preferred to use an activating gas supply unit which includes a liquid vaporization device having an absorber, part of which is in contact with a liquid such as water and a heater provided in contact partially with the absorber to generate a vapor, and a source of an inert carrier gas. The vapor and the inert gas are mixed in an appropriate ratio and fed while controlling the amount of the feed. The continuous, vertical furnace for carbonization and activation according to the invention ensures formation of carbon and activated carbon products with more uniform properties, including a specific surface area and a basis weight, in larger amounts than known batch-type furnaces.

Reference is now made to the accompanying drawings and particularly, FIGS. 1 to 5. In FIG. 1, there is generally shown a vertical carbonization and activation furnace F according to the invention. The furnace F has a closed furnace body 32 provided with openings 30, 31 at the top and bottom thereof. The closed furnace body 32 is surrounded with a heating unit 33 such as, for example, a silicon carbide heater and is entirely surrounded with a heat insulative unit 34 made, for example, of alumina fibers, brick or the like. The opening 31 at the lower portion of the furnace body 32 is connected to a closed chamber 35. The furnace body 32 has also activating gas supply ports 36 located near the opening 31 and/or activating gas supply ports 37 at intermediate or side wall portions, one of the gas supply ports 37 at the left side being not shown in the figure. The gas supply ports 36 and 37 are, respectively, connected to an activating gas generator 38 through feed pipes 39 and 40, through which an activating gas is introduced into a furnace chamber 41 established in the furnace body 32. Into the furnace chamber 41 and the closed chamber 35, an inert gas, such as nitrogen gas, used as a carrier gas for the activating gas and an inert gas, which is forced into the closed chamber 35 through a pipe 42 from an $N_2$ bomb 73, are introduced so that oxygen in the chambers 35, 41 is controlled to be present in amounts, for example, not larger than 10% by volume. In order to stably maintain the temperature and the low concentration of oxygen in the furnace chamber, curtains 43,44 of inert gases may be provided as at the outlets or in the vicinity of the openings 30, 31, respectively.

The furnace body 32 is connected at the openings 30 to an upper closed chamber 45, which in turn connects through an upper opening 46 to an exhaust gas treating unit 47. The exhaust gas treating unit 47 has a pair of heaters 49, 50 which is in face-to-face relation with each other through a space 48. Hydrocarbon gases which will generate from the activation furnace F are combusted on passage through the space 48, whereby the hydrocarbon gases are decomposed or oxidized into $CO_2$, $H_2O$ and lower hydrocarbons. The exhaust gas treating unit 47 has a primary air intake port 51 and a secondary air intake ports 52, from which air is introduced for use in combustion of the hydrocarbon gases.

Figure 2:
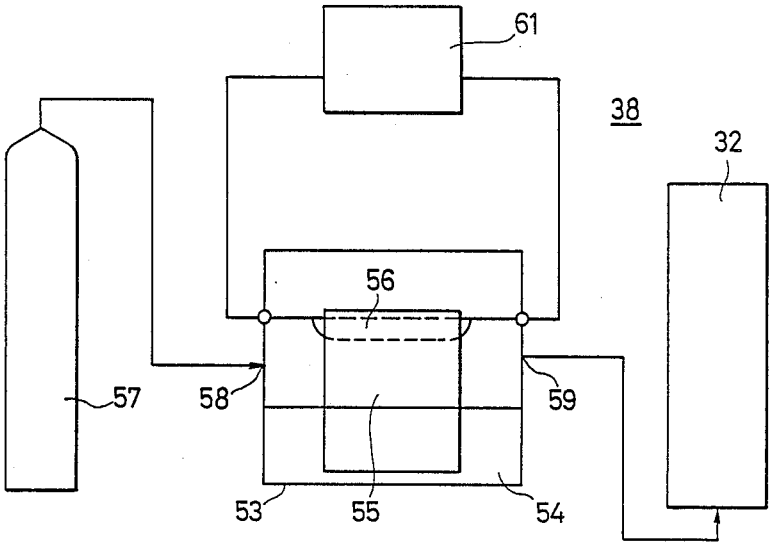
FIG. 2 is a schematic view illustrating an activating gas generator used in the furnace of the invention.
Figure 3:
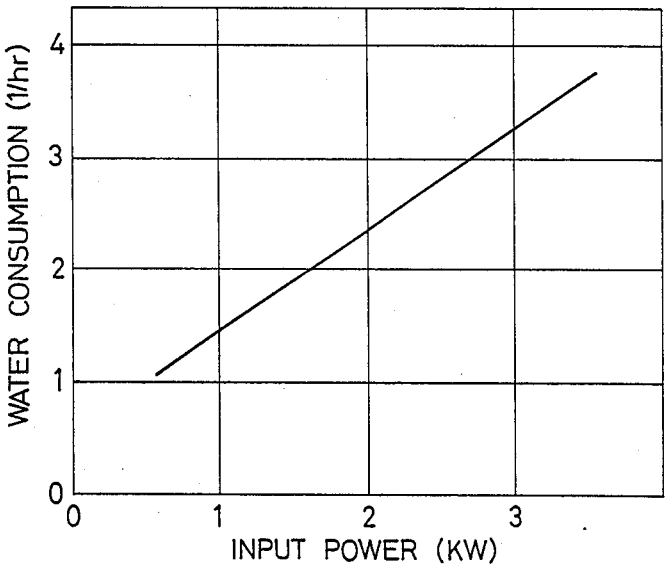
FIG. 3 is a graphical representation of water consumption in relation to electric power when water is used as an evaporation source in the activating gas generator of FIG. 2.

The activating gas generator 38 is more particularly described with reference to FIG. 2. The generator 38 includes a closed container 53. The container 53 has a liquid 54, a porous absorber 55 such as, for example, a glass fiber cloth, partially in contact with the liquid, and a heater 56 which contacts part of the absorber 55. An inert gas bomb 57, such as argon, nitrogen or the like, is connected to the container 53 so that a carrier gas from the bomb 57 is passed from an inlet 58 into the container 53. The vapor of the liquid 54 generated by the action of the absorber 55 and the heater 56 is supplied from an outlet 59 into the furnace body 32 using the inert carrier gas. Reference numeral 61 indicates a power control unit for the heater 56, by which a steam feed per unit hour can be accurately controlled. As a matter of course, the activating gas generator 38 is not limited to one described above. For instance, the activating gas may be obtained by bubbling an inert gas into a liquid of a higher temperature contained in a container, or by a high-pressure and high-temperature container such as an autoclave for generating a vapor or steam. The activating gas generator 38, which has such a construction as shown in FIG. 2, is preferred. This is because the amount of steam generated is accurately, linearly controlled in proportion to input power for the heater 56 as particularly shown in FIG. 3. In this sense, the generator 38 is most appropriate as an activating gas generating source. In FIG. 3, the liquid used is water.

The carbonizing and activating operations using the activating furnace F described above are particularly described with reference to FIG. 1.

A starting material 62, such as a cloth, is passed by means of drive rolls 63 from an inlet 64 into the upper closed chamber 45 and then into the furnace chamber 41 through a guide roll 65. The furnace chamber 41 is maintained at a high temperature of, for example, 800° to 1200° C. In the furnace chamber 43, an oxidative gas such as, for example, steam, $CO_2$ or $O_2$ is supplied along with an inert carrier gas in an upward direction from the lower ports 36 and/or intermediate ports 37. During passage in the downward direction, the starting cloth 62 uniformly contacts the activating gas passing in a direction opposite to the direction of the movement of the cloth, by which uniform carbonization and activation are ensured. Subsequently, the starting cloth 62 is passed from the lower opening 31 into the lower closed chamber 35. The starting cloth 62, which has been activated, is taken up by means of an automatic takeup device 66 provided in the lower closed chamber 35. During the activation, the furnace chamber 41 is maintained at a low concentration of oxygen, thus the activation reaction proceeding rapidly. This is faciliated by the use of the curtains 43, 44 of an inert gas as described before.

The number and position of the feed ports for the activating gas depend on the width, thickness and fiber size of a starting material to be activated. Preferably, a plurality of feed ports which are located as putting the starting material between the ports although one port may be sufficient for carbonization and activation according to the invention.

In the above embodiment, the starting material is illustrated as moving in the downward direction, but it is possible to feed the starting material from the lower closed chamber 35 in an upward direction, activated in the furnace chamber 41, and taken up in the upper portion. The feed of the activating gas is controlled by valves 67, 68 and is possible from either or both of the ports 36, 37 as will be described hereinafter. In this case, the activating gas is naturally discharged from the upper opening by the draft effect.

The advantages of the vertical furnace system of the invention using two ports for the activating gas are described with reference to FIG. 4.

Figure 4A:
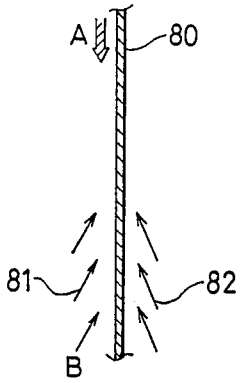
FIGS. 4*a* and 4*b* are schematic views illustrating the preference of a vertical furnace of the invention to a horizontal system.
Figure 4B:
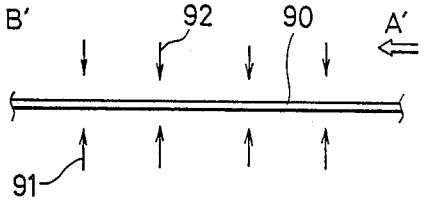

When a starting material 80 is fed in the furnace F in a vertical direction and is moved from position A to position B in FIG. 4*a*, activating gases 81, 82 supplied from a lower position contact the material 80 on opposite surfaces to permit a uniform activation reaction. Accordingly, the resulting continuous product is uniform in quality at any portions thereof. This is ascribed to a uniform reaction occurring on the continuous product. On the other hand, when a material 90 to be activated is moved horizontally from position A' to position B' in FIG. 4*b*, it becomes difficult to feed activating gases 91, 92 against the material 90 uniformly on both surfaces of the material 90 in view of the distribution of temperature in the furnace and the gravity exerted on the material 90. In fact, the activated product obtained by the horizontal system has the drawback that the activation proceeds in a higher degree on one surface than on the other surface.

The carbon products obtained by the furnace according to the invention have, more or less, different characteristic properties depending on the manner of feeding of the activating gas. More particularly, when fibrous materials are carbonized and activated in the furnace F of FIG. 1, the activating gas may be supplied (1) from one or two ports 36 alone at the lower portion of the furnace, (2) from both the ports 36 and the intermediate ports 37, and (3) from one or two intermediate ports 37 alone. With the cases of (1) and (2), the furnace chamber 41 is wholly filled with the activating gas although the concentration of the activating gas may vary depending on the manner of the supply (1) or (2). Accordingly, the material is carbonized and activated continuously throughout the chamber 41 in a manner as shown in FIG. 4*a*. On the other hand, with the case of (3), the furnace chamber 41 is divided into an activating gas passage section 41A at an upper portion of the chamber 41 and an inert gas section 41B. As a result, when the starting material is continuously passed from the upper opening 30 toward the lower opening 31, the material is first carbonized and activated and then merely thermally treated continuously, without exposure to an outside atmosphere, in an inert gas. This permits continuous operations of the carbonization and activation and the subsequent thermal treatment. This is one of prominent features of the invention. In this procedure, the carbonization and activation is effected at temperatures 800° to 1200° C. for a time sufficient to allow the carbonization and activation, moe or less, depending on the type of material to be treated. The activating gas in an inert carrier gas may be steam, $CO_2$ or $O_2$ and is contained in an amount of from 5 to 100% by volume for steam and $CO_2$ and up to 10% by volume for $O_2$ based on the total gas mixture. In the subsequent thermal treatment step, the material is treated at temperatures up to 1200° C. in an atmosphere substantially free of the activating gas. The carrier gas is passed at a suitable rate of, for example, 20 liters per minute, depending on the treating conditions in the furnace and the type of starting material.

Figure 5:
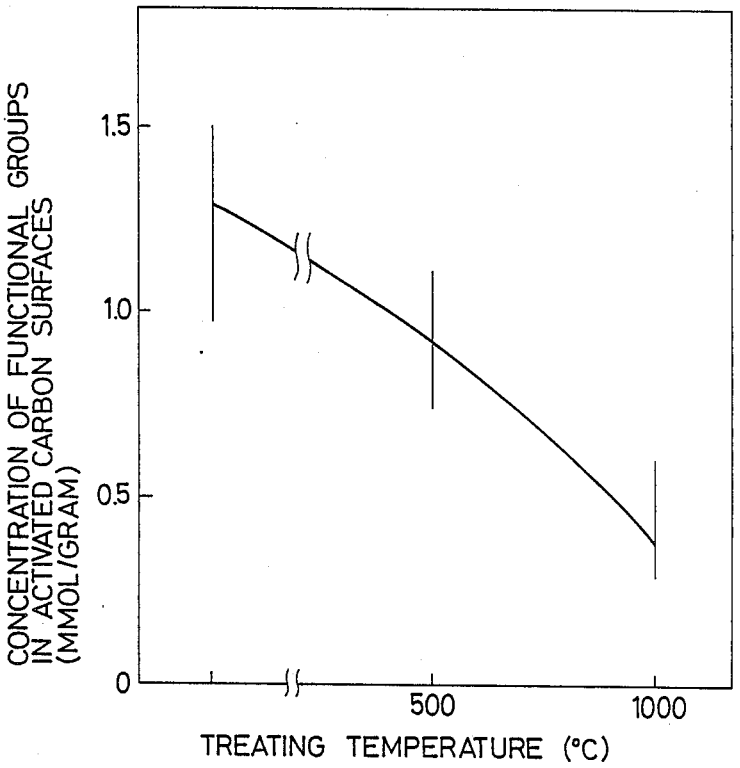
FIG. 5 is a graphical representation of a concentration of functional groups in the surface of activated carbon in relation to heat-treating temperature of the activated carbon.

In general, activated carbon has a large specific surface area and is thus high in absorptivity. The degree of activity on the carbon surfaces depends largely on the type of atmosphere in a final stage of the activation procedure. With activated carbon products obtained by the carbonization and activation procedure using the feed manners (1) and (2), the activation reaction completes by contact with low temperature steam, so that there is the possibility of physical adsorption of moisture on the product surface, or the possibility of formation of functional groups such as —OH, —COOH and the like on the surface. The moisture adsorption and the formation of the functional groups do rarely influence the absorptivity of the resulting product when they are used as an ordinary adsorber. However, when such a carbon product is applied, for example, as polarizable electrodes of an electric double layer capacitor, the moisture adsorption and the formation of the functional groups will become defective. In FIG. 5, there is shown the relationship between the content of functional groups in surfaces and the thermal treatment temperature. The content of functional groups decreases with an increase of the thermal treatment temperature.

As will be apparent from the foregoing, different types of carbon products can be effectively obtained by continuous operations according to the invention. The activated carbon product obtained by the present invention is characterized by a high specific surface area of from 2000 to 3000 $m^2/g$ and a tensile strength of from 30 to 50 $kg/mm^2$.

The present invention is more particularly described by way of examples.

EXAMPLE 1

A cloth having a width of 100 cm and a basis weight of 200 $g/m^2$ and made of phenolic resin fibers was carbonized and activated in the carbonization and activation furnace shown in FIG. 1. The furnace temperature was 900° C. and the furnace had a furnace chamber having 30 cm in length, 110 cm in width and 20 cm in depth. The activating gas generator of FIG. 2 using water as the liquid 54 was employed to generate steam. The steam was supplied from the lower port 36 alone while closing the valve 68 but opening the valve 67 of FIG. 1. The power for the heater of the generator 38 was 1 KW and nitrogen gas was used as a carrier gas and passed at a flow rate of 20 liters/minute. In this example, the starting cloth was passed from the upper portion of the furnace into the chamber while supplying the steam countercurrently. The resulting activated carbon cloth have charcteristics indicated in Table 1 below, along with characteristics of an electric double layer capacitor fabricated by the following manner.

Figure 6:
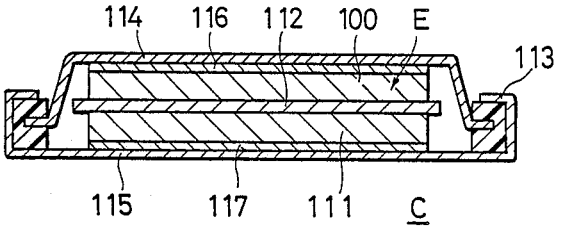
FIG. 6 is a schematic view of an electric double layer capacitor using an activated carbon fiber, prepared according to the invention, as polarizable electrodes.

An electric double layer capacitor C fabricated is as shown in FIG. 6 and includes two pieces 110, 111 of the activated carbon cloth intervening a separator 112 of a non-woven polypropylene fabric, thereby giving a capacitor element E. The element E is placed in a casing composed of members 114, 115 sealed with a gascket ring 113. The carbon cloth pieces 110, 111 are made by forming a 300 micrometer thick aluminum layers 116, 117, by a plasma spray coating method, on one surface of the activated carbon fiber cloth obtained in Example 1 and punching the coated cloth in the form of a disk having a diameter of 5 mm. The disk pieces 110, 111 are superposed through the separator 112 such that the activated carbon layers are facing each other. The disk pieces 110, 111 and the separator 112 are impregnated with an electrolytic solution of $(C_2H_5)_4NBF_4$ in propylene carbonate having a concentration of 1 mole/liter.

EXAMPLE 2

The general procedure of Example 1 was repeated except that the starting cloth was passed from the lower opening 31 into the furnace chamber in an upward direction, so that the starting cloth was moved in the same direction as the activating gas flow. The results are also shown in Table 1.

Comparative Example 1

A 100 cm wide and 10 m long cloth of phenolic resin fibers having a basis weight of 200 $g/m^2$ was carbonized and activated in a known furnace of the batch type in which the cloth was suspended from a holder, as set forth before, under conditions of a temperature of 700° C. a content of steam, serving as an activating gas, of 50% by volume. It took about 10 hours in total before the carbonization and activation at 900° C. were completed and the furnace was subsequently cooled down to room temperature. The resulting activated carbon cloth was used to make an electric double layer capacitor in the same manner as in Example 1. The characteristics of the activated cloth and the electric double layer capacitor are shown in Table 1.

Comparative Example 2

Figure 7:
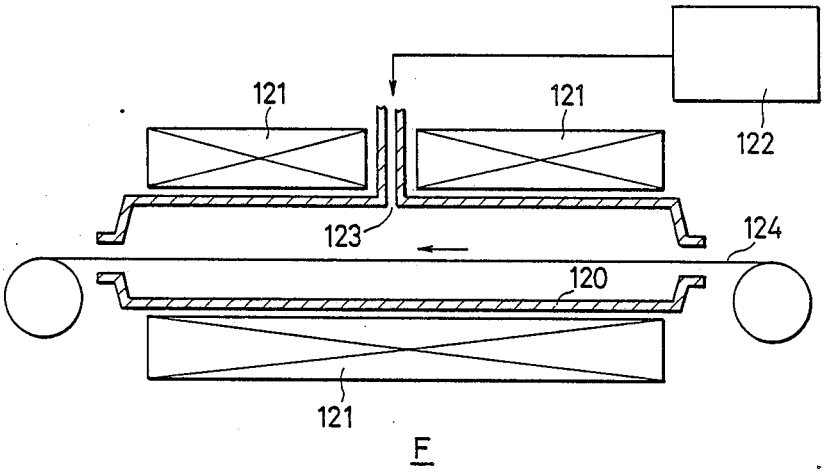
FIG. 7 is a schematic view of a horizontal activating furnace used only for comparison.

The general procedure of Example 1 was repeated except that the furnace was constructed such that the cloth was continuously moved horizontally from the right to left side as viewed in FIG. 7. In FIG. 7, the furnace F includes a muffle furnace body 120 surrounded by heaters 121. An activating gas generator 122 is connected to the muffle furnace body 120 through a gas feed port 128. Reference numeral 124 indicates a material to be activated which is moved horizontally.

The characteristics of the resulting activated carbon cloth and an electric double layer capacitor using the carbon cloth are shown in Table 1.

TABLE 1

| Characteristics of Activated Carbon Cloth | | | | Characteristics of Electric Double Layer Capacitor | | Productivity | |
|---|---|---|---|---|---|---|---|
| Specific Surface Area ($m^2g$) | Basic Weight ($g/m^2$) | Yield of Carbonization (%) | Strength ($kg/mm^2$) | Capacitance (F) | $-\Delta C$ (%) | Production Rate ($m^2$/hour) | Uniformity of Carbonization & Activation |
| [Example 1] | | | | | | | |
| 2500 | 80 | 50 | 30–50 | 0.3 | −2 | 2 continuous | specific surface area = ±5% |
| [Example 2] | | | | | | | |
| 2400 | 80 | 50 | 30–40 | 0.3 | −10 | 2 continuous | specific surface area = ±10% influenced by adsorption of exhaust gas |
| [Comparative Example 1] | | | | | | | |
| 1800 | 60 | 20 | ~30 | 0.2 | −30 | 1/5 to 1/10 of the furnace of the invention | specific surface area = ±30% |
| [Comparative Example 2] | | | | | | | |
| 2000 | 70 | 30 | ~40 | 0.25 | −15 | 2 continuous | great variation in activation on both surfaces |

In the above table, $\Delta C = 1 - (\text{capacitance at } -25° \text{ C.}/\text{capacitance at } 25° \text{ C.})$.

EXAMPLES 3-4

The general procedure of Example 1 was repeated except that steam used as the activating gas was supplied from the ports 37 while closing the valve 67 and opening the valve 68 and (nitrogen gas) serving as an inert gas was supplied under pressure from the lower opening 31. The resulting activated carbon fiber cloth was used to fabricate an electric double layer capacitor of the same type as in Example 1.

The activated carbon fiber cloth and the capacitor were subjected to measurement of characteristics, some of which were different from those indicated in Table 1. The results are shown in Table 2, in which those characteristics of the activated carbon fiber cloth of Example 1 and the capacitor using the carbon fiber cloth are also shown, along with the characteristics of the activated carbon fiber cloth of Example 1 which was subsequently thermally treated in a batch-type heat-treating furnace at 800° C. for 2 hours (Example 4).

TABLE 2

| Characteristics of Activated Carbon Cloth | | | | Characteristics of Electric Double Layer Capacitor | | |
|---|---|---|---|---|---|---|
| Specific Surface Area ($m^2/g$) | Average Pore Size (angstrom) | Yield of Carbonization (%) | Degree of Acidity (mmol/g) | Capacitance (F) | $-\Delta C$ (%) | LC 3.0 V, 60 minutes (μA) |
| [Example 3] | | | | | | |
| 2500 | 25–50 | 45 | 0.2 | 0.3 | ~0 | 1 |
| [Example 1] | | | | | | |
| 2500 | 20–40 | 50 | 1–1.5 | 0.3 | −2 | 10 |
| [Example 4] | | | | | | |
| 2500 | 25–45 | 40 | 0.5–1 | 0.28 | −1 | 1 |

In the above table, the degree of acidity is intended to mean a concentration of functional acidic groups per gram of activated carbon.

LC is intended to mean a leakage current at 3.0 V after 60 minutes.

As will be seen from the above results, the activated carbon cloth of Example 3 is improved over the activated carbon cloth of Example 1 particularly with respect to the leakage current.

As will be appreciated from the foregoing, the apparatus of the invention is suitable for carbonization and activation of continuous fiber materials. Especially, when the materials are moved countercurrently with the activating gas flow, the following advantages are shown.

(1) A uniform distribution of temperature in the furnace is readily attained.

(2) Since the activating gas is passed countercurrently with the material, uniform carbonization and activation reactions can proceed using a large amount of the activating gas.

(3) Since the furnace is of the vertical type, the gas produced by the carbonization and activation reactions is rapidly discharged to outside by the draft effect.

(4) when an exhaust gas incinerator is additionally installed, hydrocarbon gases produced by the activation can be readily decomposed into harmless gases.

In the above examples, the carbonization and activation of fibers is described. Carbonized fiber articles may be activated by the use of the apparatus and method of the invention. Moreover, if an inert gas is supplied from feed ports 36, 37 without charging any activating gas, the furnace may be utilized as a carbonization furnace.

The carbon or activated carbon products obtained by the present invention have wide utility in the fields of adsorbing agents for various gases or liquids and of electrodes such as of an electric double layer capacitor, an energy storage device using a positive carbon electrode and a negative electrode of a wood alloy (e.g. Sn-Pb alloy) doped with Li.

In the above table, the continuous carbonization and activation of a wide, continuous cloth is shown, but continuous fiber articles consisting of long fibers in the form of a tow, roving or the like, may be likewise carbonized and activated. These products have better characteristics with a better productivity than those products obtained by known batch-type furnaces.

As described before, the characteristics of activated fibers are greatly influenced by a rate or increasing or decreasing a temperature in a batchwise furnace. The rate has been at most 200° C./hr, so that one batch cycle of the carbonization and activation takes one to several days. In contrast, the furnace of the invention is advantageous in that the carbonization and activation speed can be readily, arbitrarily controlled by control of the speed of feeding a material to be activated into the chamber. In addition, since the material being activated is continuously fed into the chamber, the heat capacity of the material becomes so small as to be negligible as compared with the heating power in the chamber, thus ensuring the continuous carbonization and activation at a high speed.

What is claimed is:

1. A vertical furnace for continuously carbonizing and activating continuous fiber materials which comprises:

a furnace chamber including means for defining openings in upper and lower portions thereof, through which a continuous fiber material is passed in a vertical direction, at least two ports through which a gas for facilitating carbonization and activation of the fiber material is passed, and a heating means for keeping said furnace chamber at temperatures sufficient to carbonize the fiber material;

means for continuously feeding the fiber material from one of the openings and taking up from the other opening; and an activating gas supply means for supplying an activating gas into the furnace chamber through the at least two ports for activating and carbonizing the fiber material from opposite sides thereof, said activating gas supply means comprising an activating gas generator which includes a closed container having a liquid capable of generating an activating gas, a porous absorber part of which is immersed in the liquid, and a heater which is in contact with said porous absorber so that the liquid absorbed by the porous absorber is vaporized, and a supply of an inert gas serving as a carrier for the activating gas generated from said generator, whereby the fiber material is carbonized and activated in said furnace chamber.

2. A vertical furnace according to claim 1, further comprising closed chambers connected to the openings of the furnace chamber to accommodate the fiber material and the final carbonized and activated material, respectively, at least one of the closed chambers in which the final carbonized and activated material is accommodated being in an atmosphere of an inert gas.

3. A vertical furnace according to claim 1, wherein said furnace chamber has four ports for supplying the activating gas so that said activating gas is more uniformly blown against the fiber material from opposite sides.

4. A vertical furnace for continuously carbonizing and activating continuous fiber materials, which comprises:

a furnace chamber including means defining openings in upper and lower portions thereof, a plurality of ports through which an activating and carbonizing gas is passed, said ports being provided at lower and intermediate portions of said furnace chamber, and a heater for keeping the temperature in the chamber sufficient to carbonize a continuous fiber material;

means for continuously feeding the fiber material from the upper opening and taking up from the lower opening; and an activating gas supply means for supplying an activating gas into the furnace chamber at least from one of the lower and intermediate portions, said activating gas supply means comprising an activating gas generator which includes a closed container having a liquid capable of generating an activating gas, a porous absorber part of which is immersed in the liquid, and a heater which is in contact with said porous absorber so that the liquid absorbed by the porous absorber is vaporized, and a supply of an inert gas serving as a carrier for the activating gas generated from said generator, whereby the fiber material is carbonized and activated in said furnace chamber.

5. A vertical furnace according to claim 4, further comprising a closed chamber connected to the lower opening of said furnace chamber in which the carbonized and activated material is accommodated, and means for supplying an inert gas into the closed chamber.

6. A vertical furnace according to claim 4, wherein said liquid is water.

7. A vertical furnace according to claim 4, wherein said activating gas is passed countercurrently with the continuous fiber material being passed from the upper opening toward the lower opening.

8. A vertical furnace according to claim 4, further comprising a means for blowing an inert gas to form gas curtains located in the vicinity of the upper and lower openings, respectively.

9. A vertical furnace according to claim 4, further comprising an exhaust gas treating unit connected to the upper opening of said furnace chamber to convert gases produced on the carbonization and activation into harmless gases.

10. A vertical furnace according to claim 9, wherein said unit includes a pair of heaters kept apart from each other to establish a space through which the produced cases are passed, and primary and secondary air inlet ports for supplying air for the conversion of the produced gases.

11. A vertical furnace for continuously carbonizing and activating continuous fiber materials, which comprises:

a furnace chamber including means defining openings in upper and lower portions thereof, a plurality of ports through which an activating and carbonizing gas is passed, said ports being provided at intermediate portions of said furnace chambers, and a heater for keeping the temperature in the chamber sufficient to carbonize a continuous fiber material;

means for continuously feeding the fiber material from the upper opening and taking up from the lower opening;

an activating gas supply means for supplying an activating gas into the furnace chamber from intermediate portions so that the activating gas is blown against the continuous fiber material being passed from the upper opening toward the lower opening, said activating gas supply means comprising an activating gas generator which includes a closed container having a liquid capable of generating an activating gas, a porous absorber part of which is immersed in the liquid, and a heater which is in contact with said porous absorber so that the liquid absorbed by the porous absorber is vaporized, and a supply of an inert gas serving as a carrier for the activating gas generated from said generator, whereby the fiber material is carbonized and activated in said furnace chamber;

a closed chamber connected to the lower opening of the furnace chamber to accommodate the fiber material after carbonization and activation; and means for passing an inert gas into the closed chamber under pressure and further into the furnace chamber through the lower opening, whereby the continuous fiber material is carbonized and activated in a section of the furnace chamber above the intermediate portion and thermally treated in a section where the passed inert gas is filled.

12. A vertical furnace according to claim 11, further comprising an exhaust gas treating unit connected to the upper opening to the furnace chamber.

13. A vertical furnace according to claim 12, wherein said unit includes a pair of heaters kept apart from each other to establish a space through which the produced gases are passed, and primary and secondary air inlet ports for supplying air for the conversion of the produced gases.

14. A vertical furnace according to claim 11, wherein said liquid is water.

15. A vertical furnace according to claim 11, further comprising a means for blowing an inert gas to form gas curtains located at outlets of the upper and lower openings, respectively.

* * * * *